US006361391B2

(12) United States Patent
Cathey et al.

(10) Patent No.: US 6,361,391 B2
(45) **Date of Patent: *Mar. 26, 2002**

(54) FIBER SPACERS IN LARGE AREA VACUUM DISPLAYS AND METHOD FOR MANUFACTURE OF SAME

(75) Inventors: David A. Cathey, Boise; Charles M. Watkins, Meridian; Darryl M. Stansbury, Boise; James J. Hofman, Boise; Robert T. Rasmussen, Boise; Surjit S. Chadha, Meridian, all of ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/775,457

(22) Filed: Feb. 2, 2001

Related U.S. Application Data

(63) Continuation of application No. 09/014,642, filed on Jan. 28, 1998, now Pat. No. 6,183,329, which is a continuation of application No. 08/528,761, filed on Sep. 15, 1995, now Pat. No. 5,795,206, which is a continuation-in-part of application No. 08/349,091, filed on Nov. 18, 1994, now Pat. No. 5,486,126.

(51) Int. Cl.[7] ..... H01J 9/24
(52) U.S. Cl. ..... 445/24
(58) Field of Search ..... 445/24

(56) References Cited

U.S. PATENT DOCUMENTS

| | | | | | |
|---|---|---|---|---|---|
| 5,329,207 | A | * | 7/1994 | Cathey et al. | 445/24 |
| 5,486,126 | A | * | 1/1996 | Cathey et al. | 445/25 |
| 5,716,251 | A | * | 2/1998 | Watkins | 445/24 |
| 5,795,206 | A | * | 8/1998 | Cathey et al. | 445/24 |
| 5,962,969 | A | * | 10/1999 | Watkins | 445/24 |
| 6,083,070 | A | * | 7/2000 | Watkins | 445/24 |
| 6,183,329 | B1 | * | 2/2001 | Cathey et al. | 445/24 |

* cited by examiner

*Primary Examiner*—Kenneth Ramsey
(74) *Attorney, Agent, or Firm*—Hale and Dorr LLP

(57) ABSTRACT

A process is provided for forming spacers useful in large area displays. The process comprises steps of : forming bundles or boules comprising fiber strands which are held together with a binder; slicing the bundles or boules into slices; adhering the slices on an electrode plate of the display; and removing the binder. In the step of forming bundles or boules comprising fiber strands, the function of the binder is initially or fully performed by glass tubings surrounding the glass fibers. The clad glass of the envelopes etches more readily than the core glass.

18 Claims, 10 Drawing Sheets

FIBER SPACERS IN LARGE AREA VACUUM DISPLAYS AND METHOD FOR MANUFACTURE OF SAME

This is a continuation of Ser. No. 09/014,642, filed Jan. 28, 1998, now U.S. Pat. No. 6,183,329, which is a continuation of Ser. No. 08/528,761, filed Sep. 15, 1995 now U.S. Pat. No. 5,795,206;which is a continuation-in-part of U.S. Ser. No. 08/349,091 filed Nov. 18, 1994, now U.S. Pat. No. 5,486,126.

GOVERNMENTAL RIGHTS

This invention was made with Government support under Contract No. DABT63-93-C-0025 awarded by Advanced Research Projects Agency (ARPA). The Government has certain rights in this invention.

FIELD OF THE INVENTION

This invention relates to flat panel display devices, and more particularly to processes for creating the spacer structures which provide support against the atmospheric pressure on the flat panel display without impairing the resolution of the image.

BACKGROUND OF THE INVENTION

It is important in flat panel displays of the field emission cathode type that an evacuated cavity be maintained between the cathode electron emitting surface and its corresponding anode display face (also referred to as an anode, cathodoluminescent screen, display screen, faceplate, or display electrode).

There is a relatively high voltage differential (e.g., generally above 300 volts) between the cathode emitting surface (also referred to as base electrode, baseplate, emitter surface, cathode surface) and the display screen. It is important that catastrophic electrical breakdown between the electron emitting surface and the anode display face be prevented. At the same time, the narrow spacing between the plates is necessary to maintain the desired structural thinness and to obtain high image resolution.

The spacing also has to be uniformly narrow for consistent image resolution, and brightness, as well as to avoid display distortion, etc. Uneven spacing is much more likely to occur in a field emission cathode, matrix addressed flat vacuum type display than in some other display types because of the high pressure differential that exists between external atmospheric pressure and the pressure within the evacuated chamber between the baseplate and the faceplate. The pressure in the evacuated chamber is typically between about $10^{-4}$ and about $10^{-8}$ Torr.

Small area displays (e.g., those which are approximately 1" diagonal) normally do not require spacers, since glass having a thickness of approximately 0.040" can support the atmospheric load without significant bowing, but as the display area increases, spacer supports become more important. For example, a screen having a diagonal measurement of 30" will have several tons of atmospheric force exerted upon it. As a result of this force, spacers will play an essential role in the structure of the large area, light weight, displays.

Spacers are incorporated between the display faceplate having a phosphor screen and the baseplate upon which the emitter tips are fabricated. The spacers, in conjunction with thin, lightweight, substrates support the atmospheric pressure, allowing the display area to be increased with little or no increase in substrate thickness.

Spacer structures must conform to certain parameters. The supports must 1) be sufficiently non-conductive to prevent catastrophic electrical breakdown between the cathode array and the anode, in spite of both the relatively close inter-electrode spacing (which may be on the order of 200 $\mu$m), and relatively high inter-electrode voltage differential (which may be on the order of 300 or more volts); 2) exhibit mechanical strength such that they prevent the flat panel display from collapsing under atmospheric pressure; 3) exhibit stability under electron bombardment, since electrons will be generated at each of the pixels; 4) be capable of withstanding "bakeout" temperatures of around 400° C. that are required to create the high vacuum between the faceplate and backplate of the display; and 5) be of small enough width so as to not visibly interfere with display operation.

There are several drawbacks to the current spacers and methods. Methods employing screen printing, stencil printing, or glass balls suffer from the inability to provide a spacer having a sufficiently high aspect ratio. The spacers formed by these methods are either too short to support the high voltages, or are too wide to avoid interfering with the display image.

Reactive ion etching (R.I.E.) and plasma etching of deposited materials suffer from slow throughput (i.e., time length of fabrication), slow etch rates, and etch mask degradation. Lithographically defined photoactive organic compounds result in the formation of spacers which are not compatible with the high vacuum conditions or elevated temperatures characteristic in the manufacture of field emission flat panel displays.

Accordingly, there is a need for a high aspect ratio space in an FED and an efficient method of making an FED with such a spacer.

SUMMARY OF THE INVENTION

According to one embodiment of the invention, a process for forming spacers between a first surface and a second surface in an FED is provided. The process comprises: placing a plurality of bound fibers on a first surface, unbinding the fibers, and placing the second surface on the fibers.

According to another embodiment of the invention, a field emission display is provided comprising: a first electrode surface, a second electrode surface, and a glass fiber spacer adhered to the first electrode surface between the first surface and the second surface.

BRIEF DESCRIPTION OF THE DRAWINGS

The present invention will be better understood from reading the following description of nonlimitative embodiments, with reference to the attached drawings, wherein below.

DETAILED DESCRIPTION OF THE INVENTION

Figure 1:
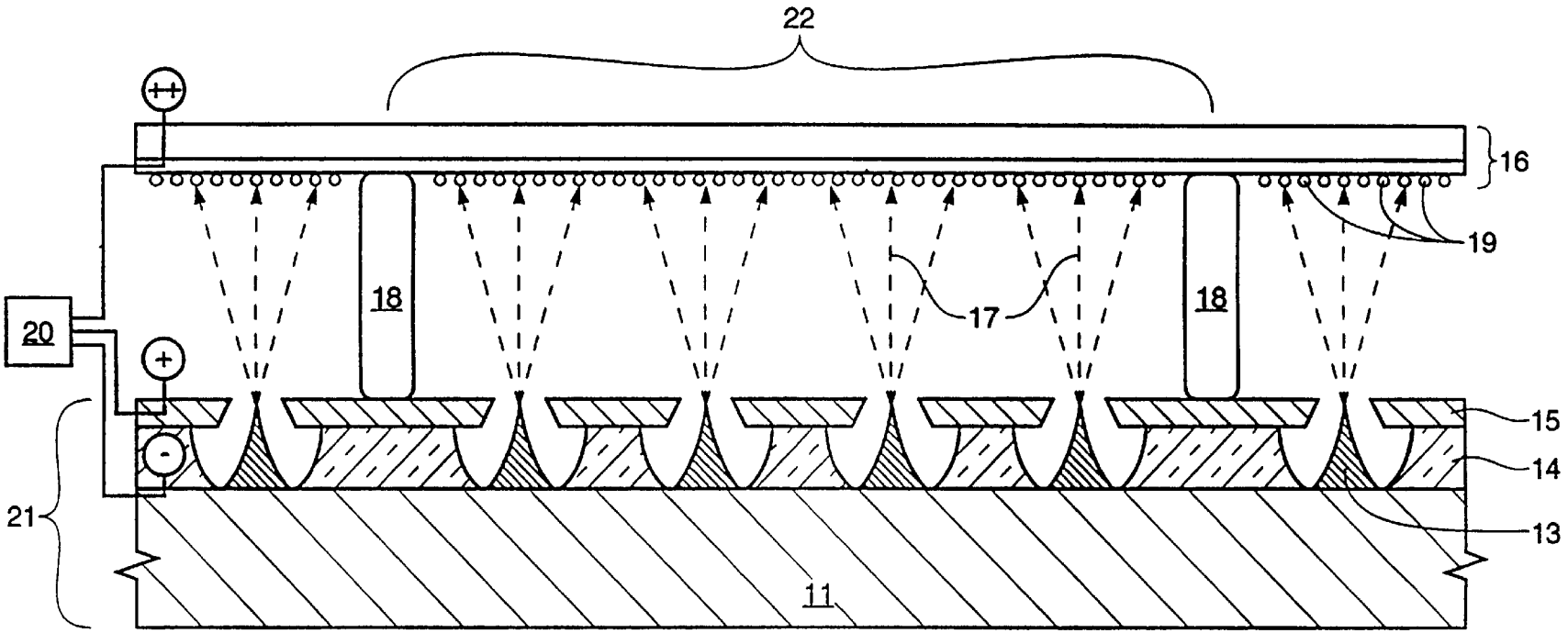
FIG. 1 is a schematic cross-section of a representative pixel of a field emission display.

Referring to FIG. 1, a representative field emission display employing a display segment 22 is depicted. Each display segment 22 is capable of displaying a pixel of information, or a portion of a pixel, as, for example, one green dot of a red/green/blue full-color triad pixel.

Preferably, a silicon layer serves as an emission site on glass substrate 11. Alternatively, another material capable of conducting electrical current is present on the surface of a substrate so that it can be used to form the emission site 13.

The field emission site 13 has been constructed on top of the substrate 11. The emission site 13 is a protuberance which may have a variety of shapes, such as pyramidal, conical, or other geometry which has a fine micro-point for the emission of electrons. Surrounding the micro-cathode 13, is a grid or gate structure 15. When a voltage differential, through source 20, is applied between the cathode 13 and the grid 15, a stream of electrons 17 is emitted toward a phosphor coated screen 16. Screen 16 is an anode.

The electron emission site 13 is integral with substrate 11, and serves as a cathode. Gate 15 serves as a grid structure for selectively applying an electrical field potential to its respective cathode 13.

A dielectric insulating layer 14 is deposited on the conductive cathode 13, which cathode 13 can be formed from the substrate or from one or more deposited conductive films, such as a chromium amorphous silicon bilayer. The insulator 14 is given an opening at the field emission site location.

Disposed between said faceplate 16 and said baseplate 21 are located spacer support structures 18 which function to support the atmospheric pressure which exists on the electrode faceplate 16 and baseplate 21 as a result of the vacuum which is created between the baseplate 21 and faceplate 16 for the proper functioning on the emitter sites 13.

The baseplate 21 of the invention comprises a matrix addressable array of cold cathode emission sites 13, the substrate 11 on which the emission sites 13 are created, the insulating layer 14, and the extraction grid 15.

The process of the present invention provides a method for fabricating high aspect ratio support structures to function as spacers 18. Briefly, the process of the present invention is a fiber approach. There are a number of process steps from raw fibers to assembled spacers 18.

Figure 2A:
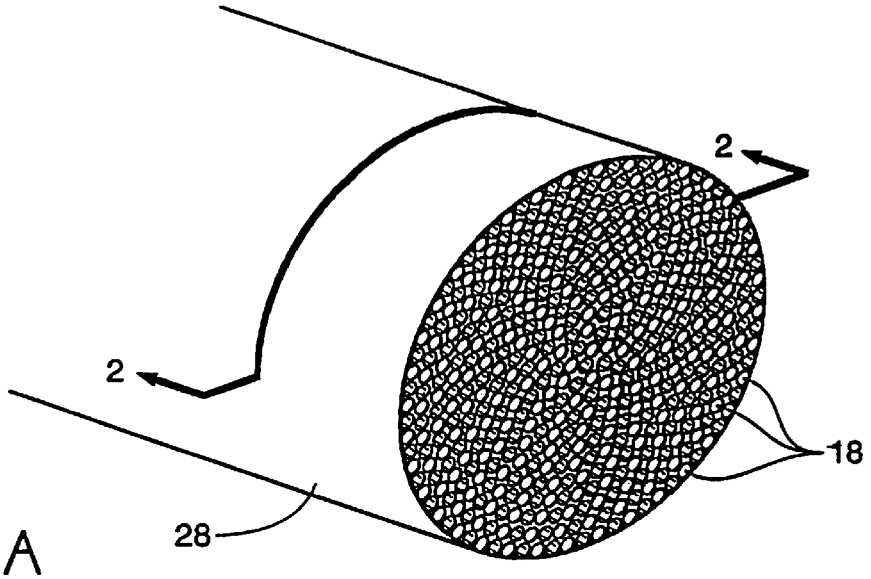
FIG. 2A is a schematic cross-section of a fiber bundle fabricated according to one embodiment of the present invention.
Figure 2B:
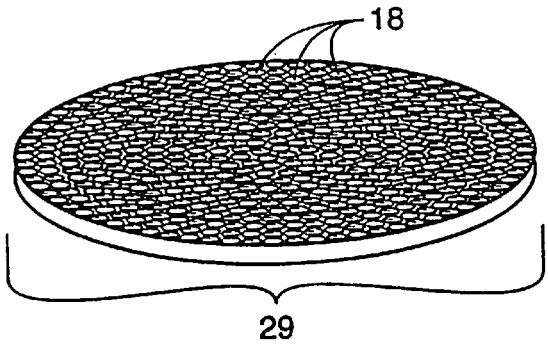
FIG. 2B is a schematic cross-section of a slice of the fiber bundle of FIG. 2 along lines 2—2.
Figure 3:
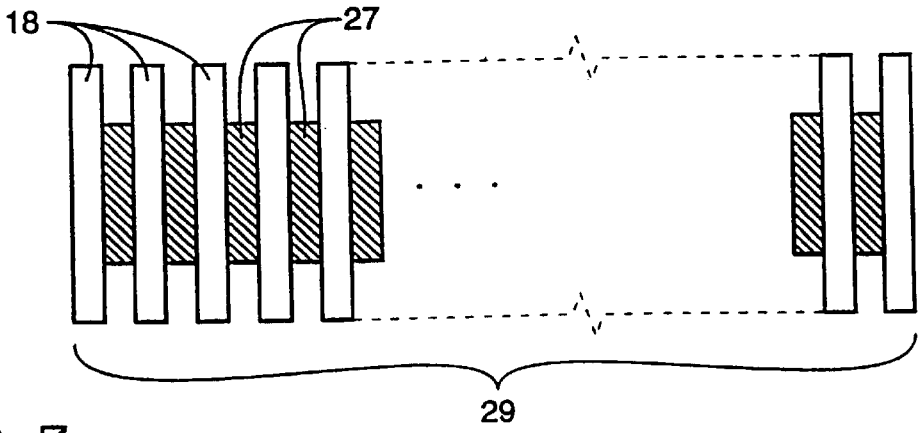
FIG. 3 is an enlarged schematic cross-section of the slice of the fiber bundle of FIG. 2A.

In one embodiment of the invention, glass fibers, 25 $\mu$m. in diameter, are mixed with organic fibers 27 such as nylon or PMMA and a bundle 28 is formed, as shown in FIGS. 2A, 2B, and 3. The PMMA fibers 27 help to maintain a substantially uniform distance between the glass fibers 18. This function is improved by the present invention, as will become apparent from FIGS. 7, 8 and 9.

In another embodiment of the invention, a removable interfiber binder (not shown), such as an acetone soluble wax is added to hold the fibers 18 together. In this embodiment, the fiber bundle 28 is formed with a dissoluble matrix. Some examples of dissoluble matrices include, but are not limited to:

a. acryloid acrylic plastic resin in an acetone/toluene solvent;

b. Zein$_{TM}$, corn protein in IPA/water based solvent, which is a food and drug coating;

c. acryloid/Zein$_{TM}$, which is a two-layer system;

d. polyvinyl alcohol (PVA) in water;

e. polyvinyl alcohol (PVA) with ammonium dichromate (ADC) in water; and f. a wax, such as those manufactured by Kindt-Collins, Corp.

One important issue relating to spacers 18 in field emitter displays is the potential for stray electrons to charge up the surface of a purely insulative spacer surface 18 over time, eventually leading to a violent arc discharge causing a destruction of the panel.

According to some embodiments of the present invention, coated fibers (not shown), or fibers with a treated surface prior to bundling are used. A temporary coating is employed so that the removable coating that provides spacing between fibers 18 may be applied to individual fibers prior to bundling, or to several fibers 18 at a time in a bundle 28 or in close proximity. Hence, the spacing between the fibers 18 comprising the bundle 28 is accomplished through the use of a removable coating.

According to another embodiment, the individual fibers are cladded by a glass tube and formed into bundles, or boules, wherein cladding and core glasses are chosen for selective etchability. One advantage of the use of etchable glass systems is their relatively high lead contents. After etching back the matrix glass to free the spacer columns, the panel may be treated to a hydrogen reduction to create a thin resistive layer on the surface of the columns.

In yet a further embodiment, the fibers 18 also employ a permanent coating to provide a very high resistivity, on the surface, but are not purely insulative, so that the coated fibers 18 allow a very slight bleed off to occur over time, thereby preventing a destructive arc over. Highly resistive silicon is one example of a thin coating that is useful on the fiber 18, having a conductivity of between about $10^{+3}$ ohms per square and about $10^{+13}$ ohms per square.

In another alternative embodiment of the invention, the glass fibers 18, and the acetone soluble PMMA fibers 27 are used together in a mixed fiber bundle 28. The PMMA fibers 27 provide a physical separation between glass fibers 18, and are dissolved after the disposition of the fiber bundle slices 29 on the display face or back plate 16, 21.

According to still a further embodiment, as seen in FIG. 7, a glass tubing B is applied, surrounding a glass rod A for providing physical separation between glass fibers 118 (FIG. 8) originating from a plurality of glass rods A. The clad glass B is etched away by applying acid, the core glass A being non-etchable or less readily etchable in said acid.

A 6"×8" field emission display (FED) with a large ½" outer border between the active viewing area and the first edge has to support a compressive atmospheric load applied to it of approximately 910 lb. It is worth noting that for a single 25 μm diameter, 200 μm tall quartz column, the buckle load is 0.006 lb. Excluding the bow resistance of the glass faceplate 16, the display would require 151,900, such columns 18 to avoid reaching the buckle point. With roughly 1 million black matrix 25 intersections on a color VGA display, the statistical capability of adhering that number of fibers 18 is useful in providing a manufacturable process window. The black matrix 25, or grille, surrounds the pixels 22 for improving the display contrast.

Referring now to FIG. 2A, after forming, the fiber bundle 28 is then sliced into thin discs 29, as shown in FIGS. 2B and 3. The bound fibers 28 are separated to between about 0.008" and about 0.013". According to a higher resolution display, a spacing of between about 3 mils to about 20 mils is used. One acceptable method of the separating comprises sawing the fiber bundle 28 (or the boule 128) into discs 29.

Figure 4:
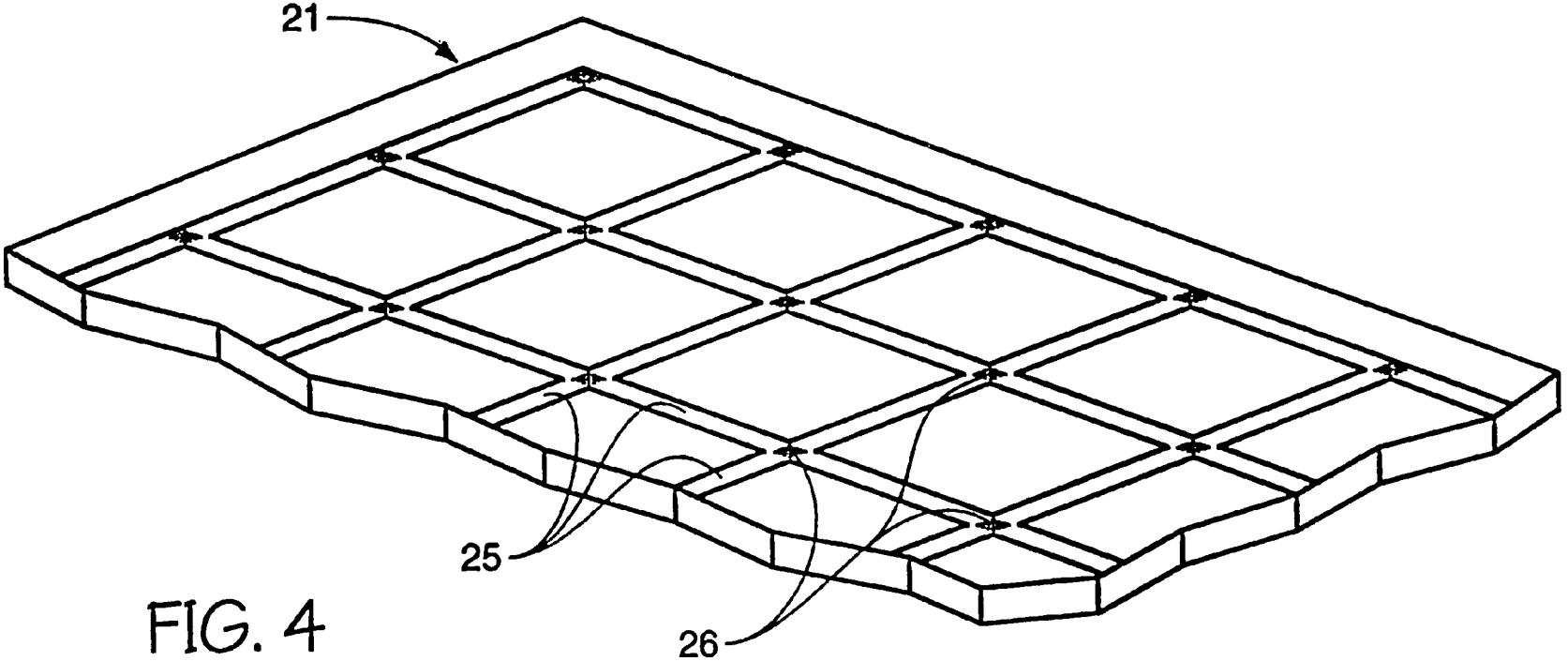
FIG. 4 is a schematic cross-section of the electrode plate of a flat panel display without the slices of FIG. 3 disposed thereon.

Referring now to FIG. 4, another aspect of the invention is shown, wherein dots of adhesive 26 are provided at the sites where the spacers 18 are to be located. One acceptable location for adhesion dots 26 is in the black matrix regions 25.

In one embodiment of the invention, a screen printing system is used to generate the predetermined adhesion sites 26 in thousands of locations on the display face or baseplate 16, 21. Alternatively, the adhesion sites 26 are lithographically defined, or formed with an XY dispense system (so-called direct writing). FIG. 4 illustrates a display face or baseplate 16, 21 on which are disposed adhesion sites 26 located in the black matrix regions 25. The black matrix regions 25 are those regions where there is no emitter 13 or phosphor dot. In these sites 25, the support pillars 18 do not distort the display image.

Dupont Vacrel is an example of a dry film that can be adapted to a glass substrate, exposed to a light pattern at approximately 400 nm. wavelengths, and developed in 1% by weight K,CO, solution. This process results in a stencil that is used to define the glue dots 26 in one embodiment. After removing excess adhesive, the film is peeled off. This method has the advantage of being alignable with projector/alignor accuracy. Adhesive may also be applied using electrophoresis. In this method a pattern is generated either in a conductive layer or by patterning an insulative layer above a continuous conductive surface. An example would be photoresist patterned using lithographic techniques to pattern openings in the resist where deposition of the adhesive is desired.

Two materials acceptable to form adhesion sites according to the invention are:

1) two part epoxies are thermally cured from room temperature to approximately 200° C. The epoxies are stable on a short term basis from 300° C.–400° C. Several are good in the range of 500° C.–540° C.

2) a cement composed of silica, alumina, and a phosphate binder. This material has a fair adhesion to glass, and cures at room temperature.

Frit, or powdered glass, may also be used as the adhesive layer, applied by settling, printing or electrophoresis.

According to the illustrated example, the slices 29 are disposed all about the display face or baseplate 16, 21, but the micro-pillars 18 are formed only at the sites of the adhesion dots 26. The fibers 18 which contact the adhesion dots 26 remain on the face or baseplate 16, 21, and the remainder of the fibers 18 are removed by subsequent processing.

Figure 6:
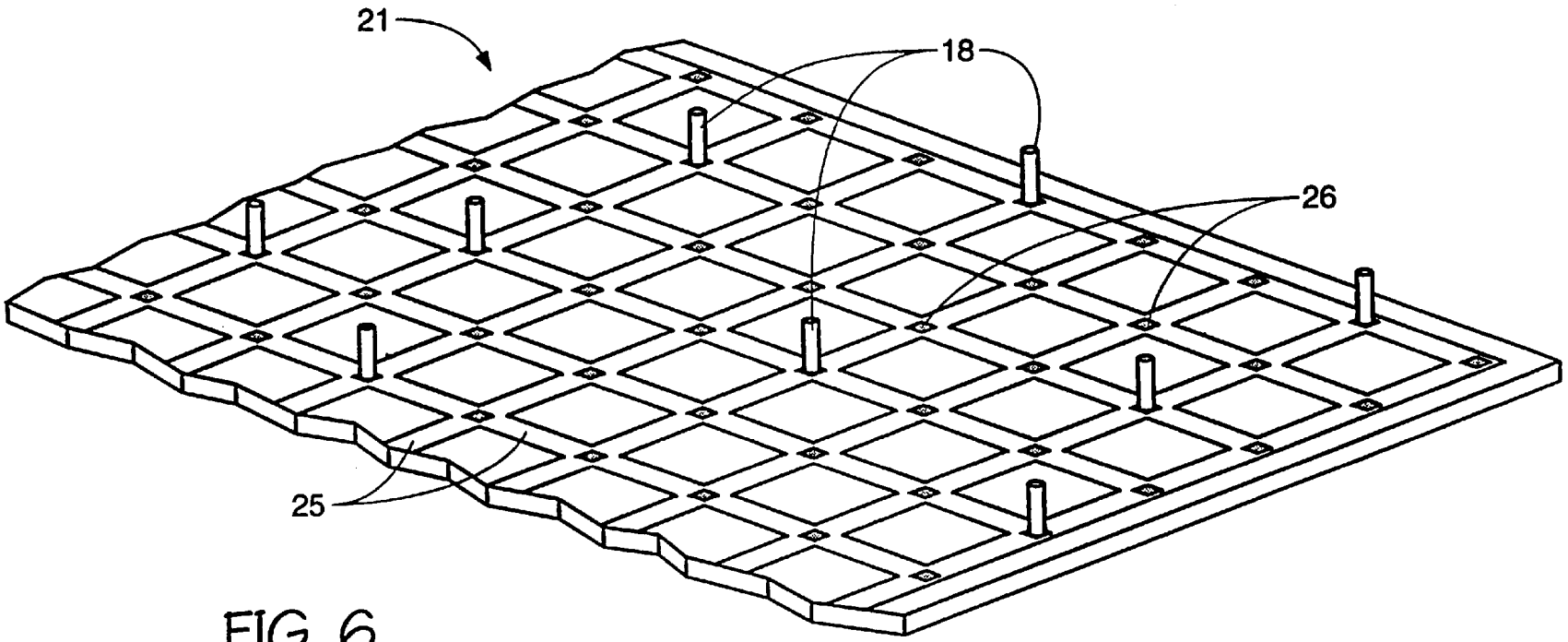
FIG. 6 is a schematic cross-section of a spacer support structure.
Figure 7A:
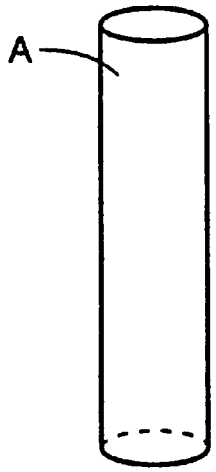
FIG. 7 is a perspective view of the first steps of an embodiment of the present invention.
Figure 7B:
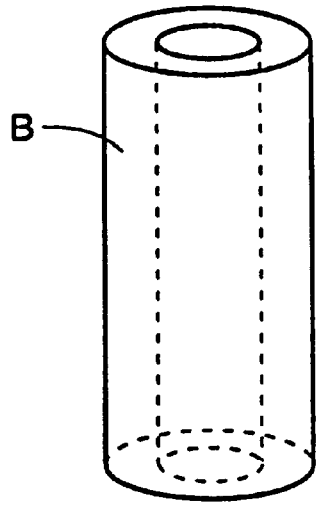
Figure 7C:
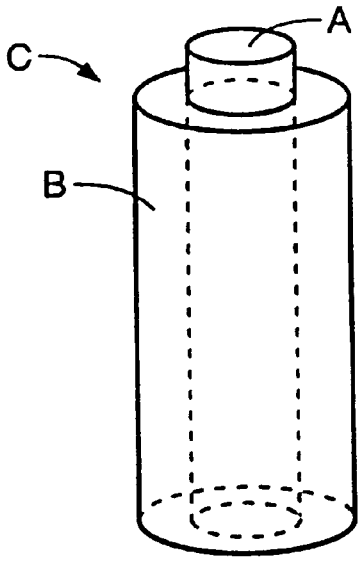
Figure 7D:
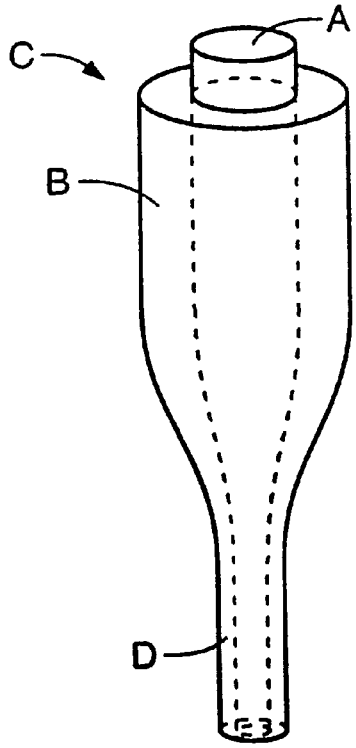
Figure 8A:
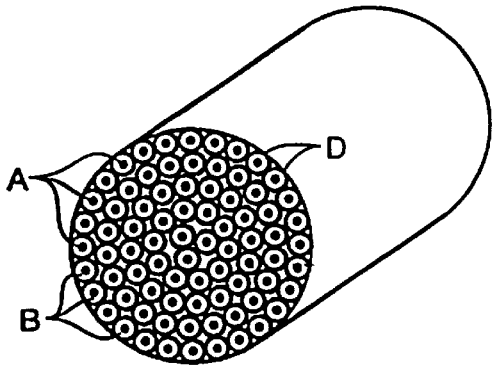
FIG. 8 is a perspective view of further steps of an embodiment of the present invention.
Figure 8B:
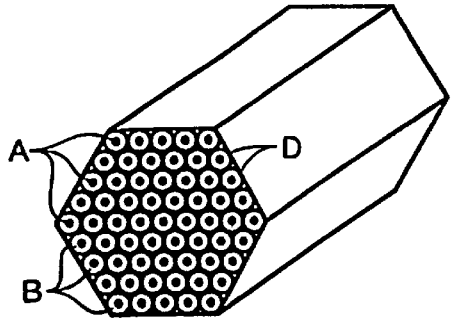
Figure 8C:
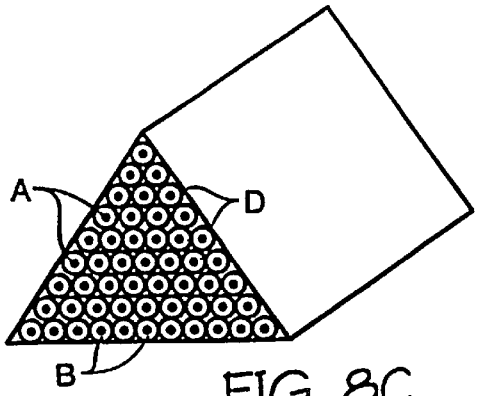
Figure 8D:
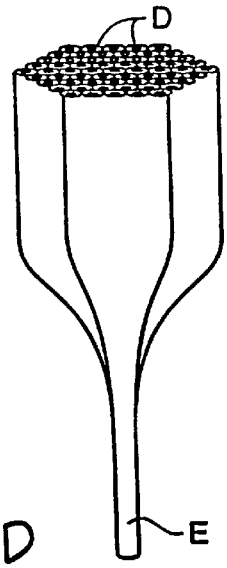

Also, according to some embodiments, there are many more adhesion dots 26 than the final number of micro-pillars 18 required for the display. Therefore, the placement of the slices 29 upon the face or baseplate 16, 21 does not require a high degree of placement accuracy. The number and area of the dots 26 and the density of the fibers 18 in the slices are chosen to produce a reasonable yield of adhered micro-pillars 18. A fiber 18 bonds to the display face or baseplate 16, 21 only when the fiber 18 overlaps an adhesion dot 26, as shown in FIG. 6. According to an alternative embodiment, only one adhesion dot is applied between any two pixel.

Figure 5:
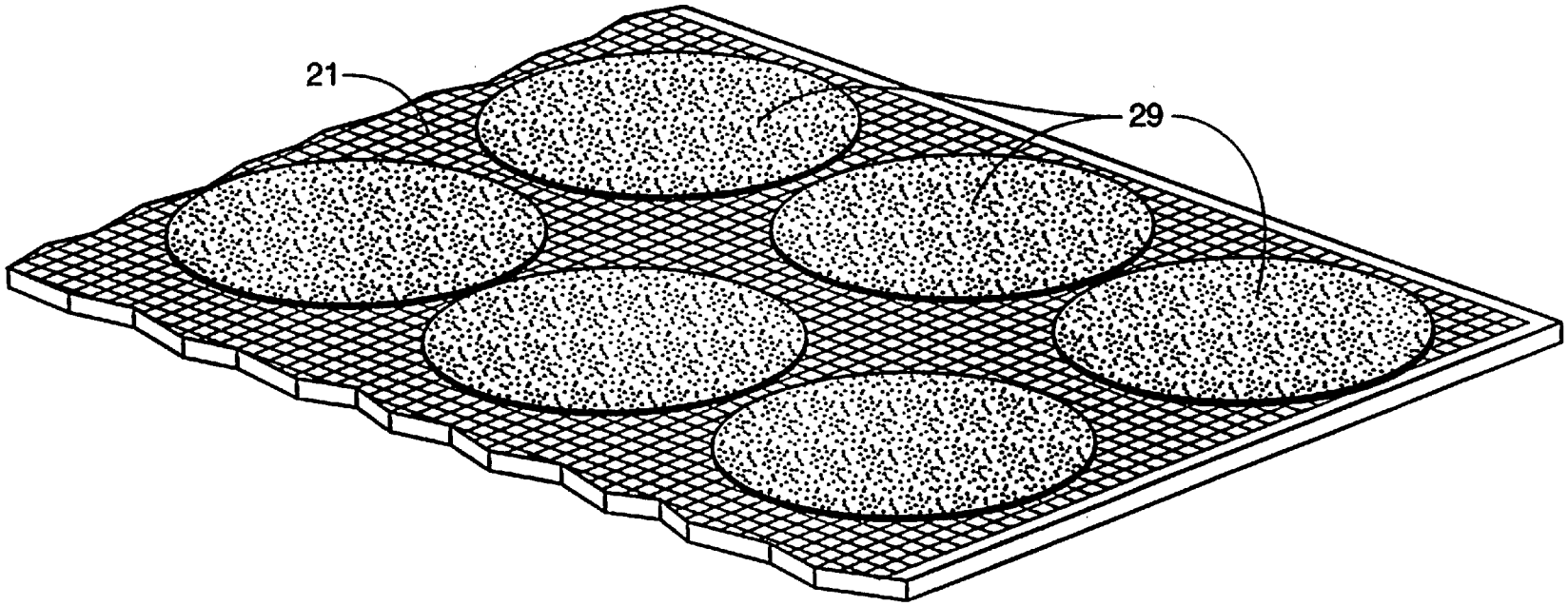
FIG. 5 is a schematic cross-section of an electrode plate of a flat panel display with the slices of FIG. 3 disposed thereon.

FIG. 5 shows the manner in which the discs 29 are placed in contact with the predetermined adhesion sites 26 on the black matrix region 25 on the faceplate 16 or in a location corresponding to the black matrix along the baseplate 21.

Depending on how well the previous steps were carried out, the fibers 18 are either all the correct height, or uneven. According to some embodiments of the invention, chemical-mechanical planarization is used to even the fibers. In the event that the fibers are still uneven after planarization, a light polish with 500–600 grit paper is used to planarize the bonded mats 29 without causing breakage or adhesion loss.

According to sill another embodiment of the invention, the display face or baseplate 16, 21 with slices 29 disposed thereon (FIG. 5) is forced against a surface 21 (for example, by clamping) to enhance adhesion and perpendicular arrangement of the fibers 18 to the face or baseplate 16, 21. When the glass fiber 18 is temporarily adhered, the organic fibers 27 and the interfiber binder material are chemically removed.

The discs 29 illustrated in FIGS. 2B and 3, and which are disposed on a display face or baseplate 16, 21, as shown in FIG. 5, are briefly exposed to an organic solvent or other chemical etchant which is selective to the glass fibers 18.

Kindt-Collins type K fixturing wax is useful as a binder in a fiber bundle 28 for maintaining the fibers 18 in their relative positions during slicing, and subsequent disposition on a display face or baseplate 16, 21. Hexane is used to dissolve the Kindt-Collins type K fixturing wax after the slices 29 have been disposed on the display face or baseplate 16, 21. In some embodiments, hexane also recesses the wax to a level below that of the ends of the glass fibers 18 in the slice 29, prior to the slice 29 being disposed on the display face or baseplate 16, 21 to aid in a more residue-free and more certain adhesion of the fibers 18 to the display plate 16, 21.

Then the glass fibers 18 which did not contact an adhesion site 26 are also physically dislodged when the binder between the glass fiber 18 is dissolved, thereby leaving a distribution of high aspect ratio micro-pillars 18. This results in glass fibers 18 in predetermined locations that protrude outwardly from the display face or baseplate 16, 21, as shown in FIG. 6, substantially perpendicular to the surface of the display face or baseplate 16, 21.

The inventive use of the bundle slices 29 is a significant aid in providing substantially perpendicular placement of the spacers 18. However, one problem in fiber spacers is that the fibers are oriented non-parallel with respect to the direction of disc thickness or are too narrowly spaced within the slices.

Therefore, another embodiment of the present invention reduces this problem by forming non-fragile 0.010" discs with fibers running parallel lengthwise to disc thickness. The percentage of correctly placed fibers, thus, is substantially increased.

Figure 9:
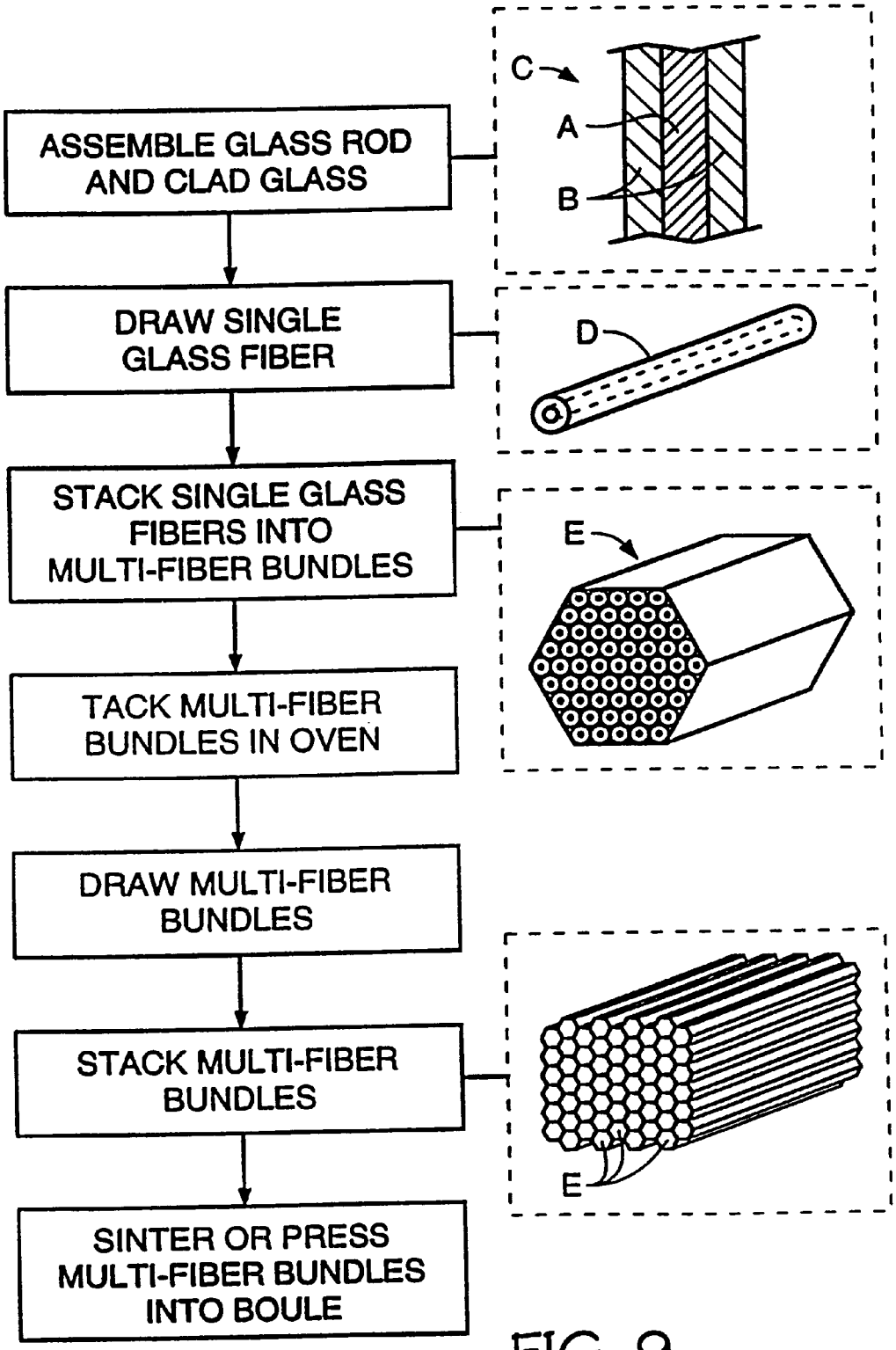
FIG. 9 illustrates a first sequence of consecutive process steps of an embodiment of the present invention.

According to this alternative, seen in FIGS. 7 and 9, glass rods A are assembled into glass tubes B. Furthermore, the step of adding a binder is initially or even fully replaced by a technique of forming cladded fibers into boules. The core glass A and the cladding glass B are chosen for selective etchability.

Several steps of glass technology are applied to transform the rod A-in-tube B-assembly C via intermediate single-fibers D and intermediate multi-fibers E into a glass boule. Such a boule is comparable to the fiber bundle of the earlier-described embodiment as it comprises a fiber strand of up to 2000 glass fibers. Depending on the selective etchability of the glass components forming the boule, is sliced to desired thickness. Slicing and adhering slices to an electrode plate of the display is performed in a like manner as disclosed herein before. Depending on the kind of filling material in the slices, either the glass component B or any organic equivalent thereof is dissolved or etched back prior to adherence, completely removed when the fiber strand has been adhered to form a spacer support structure 118.

One advantage of this method of surrounding fibers by envelopes and forming boules therefrom is that collimated spacers are made in an accurate, repeatable pattern. This reduces the cost of manufacturing and the weight of panel, since with such spacers thin panel substrates of glass can be sintered, yet hold off the forces due to atmospheric pressure. This technique will also result in high aspect ratio spacers, so higher resolution can be attained without having the output image adversely affected by the presence of spacers. This technique also increases the chances that the fiber strand is orderly and regularly distributed in the glass boule. The evenly collimated distribution is maintained throughout the spacer forming process, thereby improving the yield in the percentage of fibers fitting to the screen print pattern of glue dots.

According to this embodiment, the clad glass etches faster or more readily than the core glass. This differential etching results in a fiber pattern useful as a spacer support structure. For example, in one embodiment, the core glass A does not etch in hydrochloric acid; in another embodiment, the glass rod A has significant etch resistance to aqueous hydrofluoric acid.

Referring to FIG. 7, an example of an acceptable manufacturing process according to the present invention starts with a glass rod A, also referred to as core glass. A glass suitable for the purposes of the present invention is, e.g., potash rubidium lead glass known under the trade name Corning 8161. Core glass A does not etch in hydrochloric acid and has significant etch resistance to aqueous hydrofluoric acid. As the assembled display is later baked out, glass rod A should be distinctly close to the co-efficient of thermal expansion of the substrate materials 111 which are used for the display face and baseplate 116, 121.

The glass rod A has a diameter of about 0.25," in one embodiment, and 0.18" in another embodiment, which are substantially greater than the final glass fiber 118, having a diameter substantially in the range of 0.001" to 0.002".

As depicted in FIG. 7 and FIG. 9, the glass rod A is assembled into a glass tubing B. In one embodiment of the invention, the clad glass B is etchable in hydrochloric acid. An example for glass component B is CIRCON ACMI glass RE695. In another embodiment of the invention, glass component B is readily etchable in aqueous hydrofluoric acid. A suitable aqueous solution contains about 2% hydrofluoric acid. An example of etchable glass tube B is DETECTOR TECHNOLOGY EG-2.

In a another example of the invention, the glass tube B has an outer diameter of about 1.25" and an inner diameter of about 0.25" such that the glass rod A is insertable with the necessary clearance. Furthermore, the clad glass B is similar in melting point and co-efficient of thermal expansion to glass rod A. For example, the common softening point is approximately 600° C. A typical co-efficient of thermal expansion is about $90\times10^{-7}$ per ° C. in a temperature range of 0 to 300° C.

As shown in the FIG. 7 and FIG. 9 example, the rod-in-tube assembly C, which begins at a length of about 25", is thermally drawn down to an intermediate size. The result of this drawing step is a single-fiber D having a diameter of 0.08" in this example. The drawing step is performed in a tower. The single-fiber D has not only a reduced diameter but provides also a physical interface of the glass components A and B by reducing the clearance in assembly C.

As already mentioned before, the fibers are cut to an appropriate length as needed. Glass rod A, glass tube B, rod-in-tube assembly C or single-fiber D are cut to length, if needed.

According to still a further embodiment of the invention, permanent coating of the glass rod A is applied before assembling into glass tube B to provide a very low surface conductivity. Highly resistive silicon is an example of a thin coating that is useful on the fiber 118 in preventing a destructive arc cover. Such coating is applied by techniques commonly known in the art. A specific example of such a process used in the present invention comprises: CVD or sputtering.

Referring now to FIG. 8, examples of the invention are shown in which several of the single-fibers D are stacked to a desired shape. FIG. 8 depicts three examples of a desired shape, namely a circular, hexagonal, and triangular arrangement of stacked single-fibers D. The single-fibers D are tacked together in an oven (at a temperature above 100° C. below the glass softening temperature) so that the shape is maintained.

As depicted in FIG. 8, the stack of single-fibers D is redrawn down to the final desired dimension. According to one example, the original glass rod A is now transformed into a fiber 118 having a diameter of about 0.001". Each fiber 118 is surrounded by a selectively etchable envelope originating from glass tubing B. The fibers 118 are regularly distributed in a collimated, i.e., parallel and evenly spaced manner within the multi-fiber E.

Referring again to the FIG. 9 example, several of the multi-fibers E are stacked into a desired shape. The regular pattern of fibers 118 is substantially maintained during this stacking process. In one embodiment, the outer shape is substantially circular. In alternative embodiments the cross-sections are hexagonal, square, or some other shape that will occur to those of skill in the art.

As previously noted, after drawing, there is an interface fit between the core and clad. This is sufficient to hold the cores in some embodiments. However, in other embodiments, the stability of the core is further enhanced by placing the drawing multifiber billet in a mold and fusing the cladding under pressure, whereby a sintered, solid boule 128 is created. The boule 128 is made in a press exerting mechanical pressure on the outside of the stacked multi-fibers E. Appropriate sintering temperature is applied, as well as a vacuum of about $10^{-3}$ Torr for removing gas from the interstices between the fibers. Specific sintering parameters tested and known to be acceptable include: 582° C.±20° C. for several hours (between about 4–12 hours) with adequate time for annealing and cool down (about 19 hours for annealing and cool down). The time varies depending on thickness and pressure.

Figure 10:
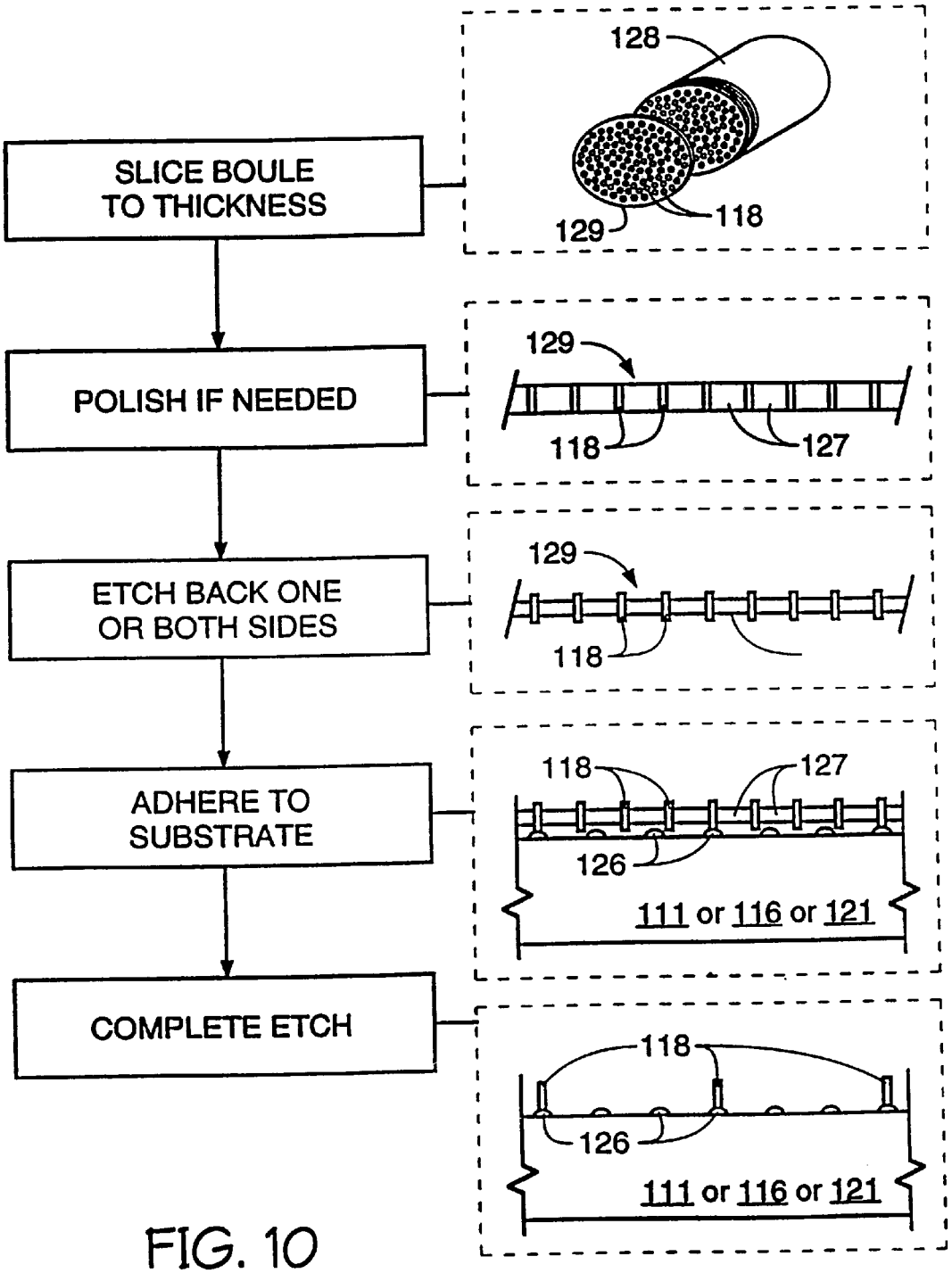
FIG. 10 illustrates a second sequence of consecutive process steps of an embodiment of the present invention.

FIG. 10 depicts the resulting boule 128 having a collimated fiber bundle 118 in an accurate and repeatable pattern. According to one embodiment of the present invention, the glass boule 128 is sliced, for example, with an ID wafering saw comprising a stainless steel membrane under tension with a cutting edge of diamond grit in a metal matrix. The thin membrane reduces kerf losses and maintains a close degree of parallelism between cuts. The discs are subsequently exposed to selective etching. According to another embodiment of the invention, the boule 128 is transformed by selective glass etching prior to slicing. The latter approach will now be explained by means of FIGS. 11A and 11B.

Figure 11A:
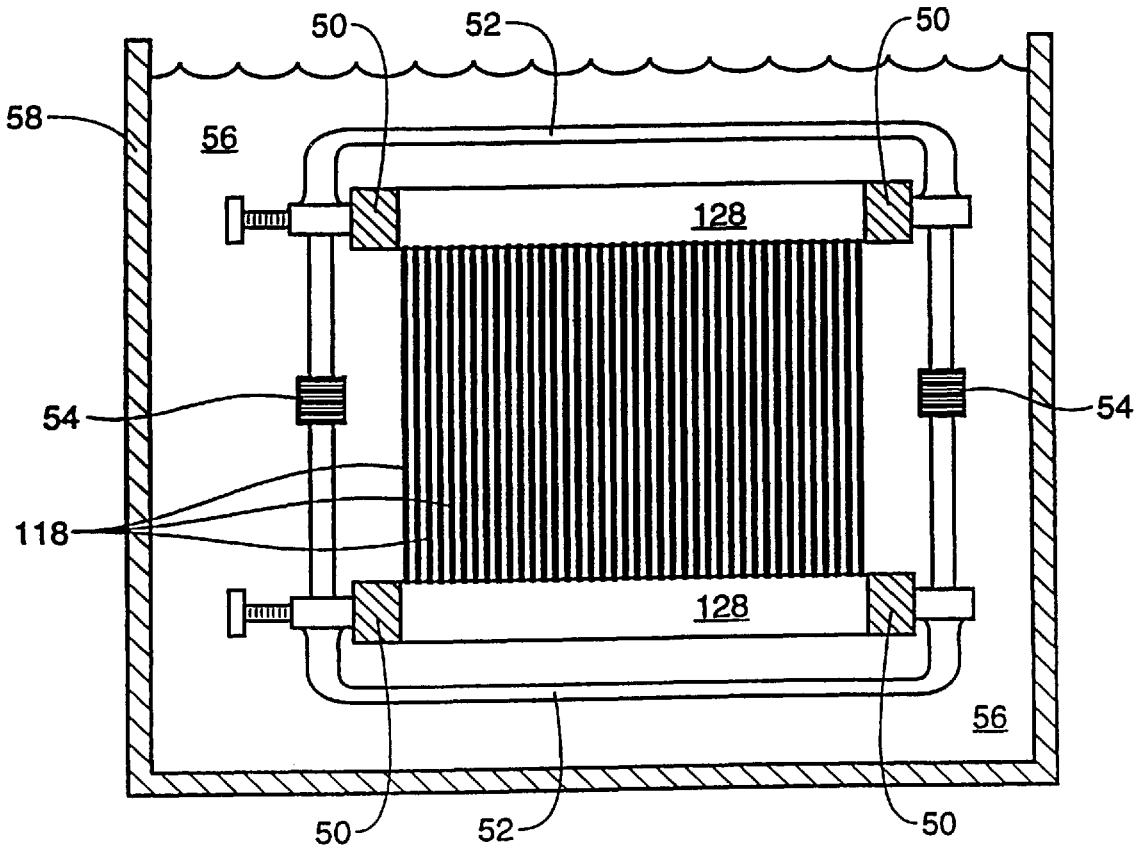
FIG. 11A is an elevational view of a process tank useful according to one embodiment of the present invention.

Referring now to FIG. 11A, the process of transforming the envelope material of the boule 128 is explained in more detail. At first, the ends of the boule 128 are physically protected from contact with acid. The protection 50 coats the ends of the boule 128 in a range where the solid structure of the boule 128 is to be maintained. In one embodiment, the first and last three inches of the length of the boules 128 are protected from etch.

Subsequently, the boule 128 is placed in a jig which puts it under tensile stress from end to end. FIG. 11A depicts two support clamps 52 and two tensors 54 as an example of an appropriate jig. The jigged boule 128 is dipped into a process tank 58 which is filled with aqueous hydrofluoric acid 56. A 2% aqueous solution of the acid 56 etches away the binder glass 127 originating from the envelope B, whereas the glass strand 118 originating from the etch resistive core glass A is maintained. Etching all the clad glass B leaves substantially equal-distant, parallel fibers 118 of 0.01", stretched between the two solid ends of the boule 128.

Figure 11B:
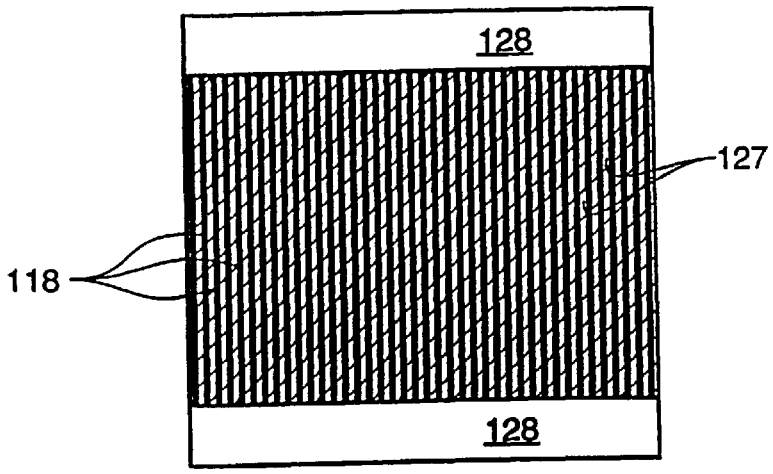
FIG. 11B is an elevational view of an alternative boule as modified according to FIG. 11A.

Referring to the example of FIG. 11B, the etched boule 128 is removed from the process tank 58, rinsed and dried. The etched boule 128 is then exposed to a material which fills the regions of the boule which have been etched away. The material 127 filling the interstices is, according to one embodiment one which is a non-newtonian fluid state. However, a newtonian fluid state exists according to other embodiments. Filling is performed by dipping the etched boule 128 into the polymer, or by squirting or injecting the polymer into the boule 128. The polymer 127 is then cured to bond with the glass strand 118. When the boule 128 is dry, it is ready for slicing. A suitable polymer material is produced by AREMCO; the trade name of this filling material is Crystal Bond 590.

Returning to FIG. 10, the boule 128 is subject to further processing steps which are similar irrespective of the specific filling material surrounding the fiber strand 118. The boule 128 is sliced to thickness to form discs 129. The process is much the same as described in conjunction with FIGS. 2A and 2B. A saw, (for example, a diamond saw) is employed to slice the boule 128 to approximately 0.008" to 0.013". According to one example, a diamond saw at 800 rpm is used on a 6" blade at a 350 g load.

According to still another embodiment, the slices 129 are coated with a thin layer of the bond or binder material 127, removable using a fast polish, if needed. The polisher uses 800 and 1200 grit silicon carbide abrasives. This step also polishes the fiber ends flat and parallel.

Referring again to FIG. 10, in another embodiment, the dissolvable bond or etchable binder 127 is partly removed from the ends of the fibers 118. This step is performed on one side or both sides of the thin disc 129. Removal on one side allows for handling of the smooth side with a vacuum wand. The solvent to be applied depends on the type of the filling material 127. According to one embodiment, the filling material 127 is a polymer binder, (for example, Crystal Bond 590), which is reacted with an organic solvent, (for example boiling methanol or acetone). According to another embodiment, the filling material 127 is a cladding glass, (for example, ACMI glass RE695). This cladding glass is partially etched back by hydrochloric acid.

According to one specific embodiment, slice 129 is made having sintered cladding surrounding core 118 and is in a dilute solution of hydrochloric acid (2%) exposing one side only of cores 118, thus preserving mechanical strength and allowing for handling of the flat side with a vacuum wand.

According to still a further embodiment, several of the slices 129 are adhered to a substrate 111. The substrate 111 represents either the faceplate 116 or the baseplate 121 of a field emission display. In one example adhering process of the present invention, the adhering step is performed in much the same way as depicted in FIG. 4 and FIG. 5, comprising: (1) applying glue dots 126 in an appropriate pattern on the substrate 111, and (2) disposing the slices 129 thereon. According to a further embodiment, a precure of the adhesive dots is performed to prevent adhesive flow from wicking, for example at 90° C. for 10 minutes, when using Epotek 354 epoxy adhesive.

After placement of the discs on the substrate, the adhesive is fully cured, and a selective etch is applied to remove cladding 127. For some reason, the etch does not proceed uniformly, resulting in stress on the disc. Also, flakes of the cladding 127 come off during the etch process, breaking supports away in the process. It has been found that a rapid etch reduced this problem. The following etches, at the following temperature and times, are acceptable.

| Etch | Temperature (Degrees C) | Time (Minutes) |
|---|---|---|
| HCL (10–30%) | 25° C. | 10–60 |
| Nitric acid (5%) | 25° C. | 10–60 |

Referring to FIG. 10, the protruding core glass pieces or fibers 118 are now adhered to substrate 111 and cured. Each remaining binder or cladding glass 127 is subsequently removed. Depending again on the kind of the filling material 127, the polymer binder, like Crystal Bond 590, is completely dissolved or the cladding glass, such as RE695 is completely etched away, as described above. The process according to the present invention leaves an electrode substrate 111, 116, 121 with high aspect ratio spacers 118.

As is shown in FIG. 6 and FIG. 10, loose fibers 18, 118 which have not been adhered to selected adhesion sites 26, 126 are physically dislodged from the adhered spacers 18, 118. It will be appreciated that the disclosed spacer structure conforms with the following requirements:

1) sufficiently non-conductive to insulate an anode plate from a cathode plate;

2) sufficient mechanical strength against atmospheric pressure;

3) stability under electron bombardment;

4) capable of withstanding bakeout temperatures of around 400° C.; and 5) small fiber diameter so as to not visibly interfere with the display operation.

According to still a further embodiment of the invention, electrophoretic deposition of the adhesive dots is performed.

According to this embodiment, the substrate comprises a conductive layer (for example, ITO or aluminum). For example, the grille of the faceplate is laid with conductive material in one embodiment. In another embodiment, the substrate comprises a cathode member having a conductive grid.

The substrate is patterned with a resist, and the pattern defines the locations desired for the adhesive dots. The patterning is performed according to a variety of methods (for example, by photolithography, direct writing, and screen printing). Then, the patterned substrate is placed in an electrophoretic bath containing the adhesive, such as 8161FRIT, which is deposited through electrophoretic processes in the desired locations due to the pattern. It should be noted that the patterned resist must be insoluble 117 the electrophoretic solution. One acceptable solution comprises:

| | |
|---|---|
| 8161 Frit | 0.010 wt % |
| Lanthanum Nitrate Hexahydrate | 0.015 wt % |
| Glycerol | 0.10 wt % |
| Isopropanol | 99.965 wt % |

In such a solution, acceptable resists include: cyclicized polyisoprenes in xylene (for example, OCG SC series resists) and polyimide resists, PVA or PVP based resists.

After deposition, the resist is removed (for example, by washing in OCG Microstrip or thermal cycle in air or $O_2$ plasma). Thus, a pattern of adhesive is deposited. In the case of a frit adhesive, after laying of the tiles of fibers on the adhesive, the structure is heated to a temperature at which the frit will adhere to the exposed fibers. Then, removal of the binding material 127 is performed.

According to still a further embodiment, in assembly of the stack of fibers, before drawing, visually distinguishable fibers are places in the fiber bundle. For example, in the case of clear fibers, a black fiber is placed in the bundle. Upon sintering into a hexagonal shape and slicing, the black fiber serves as a reference point. Then, the bundle is drawn and placed in a larger bundle of other drawn hex bundles which do not have the black fibers. The hex bundles containing the fibers are placed in the corners of the larger bundle, and the larger bundle is sintered. The resulting block is then sliced and the slice, is subjected to further processing, as described above.

According to an even further embodiment, the need for patterning of adhesive is avoided completely. Here, a slice having a partially etched side is loaded into a pick and place machine. The pick and place machine then places the partially etched side in contact with adhesive, which adheres to the exposed fibers. The slice is placed on the substrate. Further curing and etching leave the fiber supports in the appropriate position.

It should be noted that in an embodiment using the dip procedure described above, substantially all of the fibers will adhere to the substrate. Also, accurate placement is needed of the slices in, for example, those embodiments in which the supports are placed on the grille between pixels. Also, according to one specific embodiment, the slice is no wider than the grille location where the supports are desired.

According to an even further embodiment, the black fibers described above are used by a computer program in the pick and place machine to align the fiber slice and place it in the correct position on the substrate. According to one specific embodiment, 8161 frit adhesive is used and the slice (having 8161 fibers and EG-2 or RE 695 etchable glass as cladding) is to be placed on the faceplate in the grille area. These temperatures keep the viscosity of the adhesive to a level appropriate to flow onto the fiber during dip and to flow onto the substrate upon contact. The assembly is then cured and further processed as described above. Other acceptable adhesives for such a process include: Epotek 354 optical fiber epoxy and 600-3 polyimide. Kasil is a brand of an acceptable potassium silicate glass solution that functions as a cement adhesive, according to alternative embodiments, and GR-650, made by Owens Corning of Illinois is an example of an acceptable organo-silicate. Even further, soda-lime-compatible frits are used in other acceptable embodiments.

According to one experiment, an embodiment using patterned adhesive was made with a 4 mil diameter glue dot. The 4 mil process resulted in about 9000 fiber columns per square inch in the proper pattern. Epotek 354 was used as the adhesive. In another experiment, a 1 mil diameter process was used, printing polyimide adhesion sites about 2 mils apart and about 0.3 mils thick on a 11.27×8.75 mil pattern. Several slices were tiled onto an 8×10 inch substrate and cured. Acceptable quantities of 1 mil diameter columns of 10 mils height resulted.

All of the U.S. Patents cited herein are hereby incorporated by reference herein as if set forth in their entirety.

While the particular process as herein shown and disclosed in detail is fully capable of obtaining the objects and advantages herein before stated, it is to be understood that it is merely illustrative of embodiments of the invention and that no limitations are intended to the details of construction or design herein shown other than as described in the appended claims.

One having ordinary skill in the art will realize that even though a field emission display was used as an illustrative example, the process is equally applicable to other vacuum displays (such as gas discharge (plasma), flat vacuum fluorescent displays), and other devices requiring physical supports in an evacuated cavity.

What is claimed is:

1. A process for forming spacers between first and second components having respective first and second surfaces, the components for use in a flat panel display device, the process comprising the steps of:

defining a plurality of attachment sites on the first surface of the first component;

forming a bundle of glass fibers having substantially parallel axes and a face substantially perpendicular to the axes of the fibers;

placing the bundle of fibers on the first surface with the face of the bundle against the first surface; and attaching the glass fibers to at least some of the plurality of spacer attachment sites.

2. The process of claim 1, further comprising removing glass fibers that do not adhere to the first surface, placing the second surface of the second component against the fibers so that the fibers extend from the first surface to the second surface, and hermetically sealing the first and second components together.

3. The process of claim 2, wherein the second component is a conductive electrode with a voltage provided thereto.

4. The process of claim 1, wherein one of the first and second components is an anode and the other of the first and second components is a cathode, the anode and the cathode extending in parallel to each other and being sealed together with a vacuum therebetween.

5. A process of claim 4, wherein the display device is a field emission display and the cathode includes a plurality of conical electron emitters and a conductive layer serving as a gate and disposed around the emitters.

6. The process of claim 5, wherein the anode is a faceplate of a field emission display and includes a transparent substrate, a transparent conductive layer over the substrate, and phosphors over the conductive layer.

7. The process of claim 5, wherein the first or second surface is the surface of the gate.

8. The process of claim 5, wherein the anode is a faceplate of a field emission display and includes pixel regions and matrix material between the pixel regions, wherein the bundle has a diameter smaller than a width of the matrix material, and wherein the attachment sites include adhesive formed on the matrix material.

9. A process of claim 8, wherein the cathode includes a plurality of conical electron emitters and a conductive layer serving as a gate and disposed around the emitters, the pixel regions include electroluminescent material that provides light when electrons are emitted from the emitters.

10. The process of claim 9, wherein the anode and the cathode extend in parallel to each other and are sealed together with a vacuum there between.

11. The process of claim 8, wherein the placing is done with a pick and place machine.

12. A process for forming spacers for use in a flat panel display device having a cathode with a plurality of electron emitters and an anode having pixel regions and opaque material between the pixel regions, the process comprising:

defining a plurality of attachment sites on the opaque material;

having substantially parallel axes and a face substantially perpendicular to the axes of the spacers, the bundle having a diameter less than a width of the opaque material;

placing a bundle of spacers having substantially parallel axes and a face substantially perpendicular to the axes of the spaces on the opaque material; and attaching the spacers to at least some of the plurality of attachment sites.

13. The process of claim 12, wherein the placing is performed with a pick and place machine.

14. A process for forming spacers on a first component of a display device, the process comprising:

defining a plurality of attachment sites on a surface of the first component;

providing a plurality of glass spacers against the surface so that a first group of spacers contacts the defined attachment sites and a second group does not contact the attachment sites, the spacers extending away from the surface;

attaching the first group of spacers to the attachment sites; and removing the second group of spacers.

15. The process of claim 14, wherein the spacers extend to a first and second component, wherein one of the first and second components is an anode and the other is a cathode, the process including positioning the anode and the cathode parallel to each other and sealing the anode and cathode together with a vacuum therebetween.

16. A process of claim 15, wherein the cathode is for a field emission display and includes a plurality of conical electron emitters and a conductive layer serving as a gate and disposed around the emitters.

17. The process of claim 15, wherein the anode is a faceplate of a field emission display and includes a transparent substrate, a transparent conductive layer over the substrate, and phosphors over the conductive layer.

18. The process of claim 14, wherein providing a plurality includes providing a bundle of parallel glass fibers against the surface.

* * * * *